US010507964B2

(12) United States Patent
Fujihara

(10) Patent No.: US 10,507,964 B2
(45) Date of Patent: Dec. 17, 2019

(54) CUSHIONING, PACKING, AND PACKAGE

(71) Applicant: KYOCERA Document Solutions Inc., Osaka (JP)

(72) Inventor: Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 334 days.

(21) Appl. No.: 15/604,715

(22) Filed: May 25, 2017

(65) Prior Publication Data

US 2017/0349351 A1 Dec. 7, 2017

(30) Foreign Application Priority Data

Jun. 7, 2016 (JP) ..... 2016-113430

(51) Int. Cl.

| | |
|---|---|
| ***B65D 81/107*** | (2006.01) |
| ***B65D 81/05*** | (2006.01) |
| ***B65D 25/28*** | (2006.01) |
| ***B65D 43/02*** | (2006.01) |

(52) U.S. Cl.

CPC ..... *B65D 81/053* (2013.01); *B65D 25/28* (2013.01); *B65D 43/02* (2013.01)

(58) Field of Classification Search

CPC .. B65D 81/054; B65D 81/056; B65D 81/055; B65D 2519/00378; B65D 2519/00437; B65D 2519/00815; B65D 19/02; B65D 19/04; B65D 19/06

USPC ..... 206/586

See application file for complete search history.

(56) References Cited

U.S. PATENT DOCUMENTS 5,692,618 A * 12/1997 Beak ..... B65D 5/5088 206/586
2002/0139706 A1* 10/2002 Fujii ..... B65D 5/5033 206/523

FOREIGN PATENT DOCUMENTS

| | | | | |
|---|---|---|---|---|
| DE | 4115773 | A1 * | 11/1992 | ..... B65D 5/509 |
| FR | 2829474 | A1 * | 3/2003 | ..... B65D 81/056 |
| JP | S49-123284 | U | 10/1974 | |
| JP | S52-070669 | U | 5/1977 | |
| JP | 05178372 | A * | 7/1993 | ..... B65D 81/056 |
| JP | 2007-246155 | A | 9/2007 | |
| JP | 2015-209229 | A | 11/2015 | |
| WO | WO-2013065592 | A1 * | 5/2013 | ..... B65D 19/0002 |

OTHER PUBLICATIONS

An Office Action; "Notification of Reasons for Refusal," issued by the Japanese Patent Office dated Jan. 22, 2019, which corresponds to Japanese Patent Application No. 2016-113430 and is related to U.S. Appl. No. 15/604,715; with English language translation.

* cited by examiner

*Primary Examiner* — Allan D Stevens
(74) *Attorney, Agent, or Firm* — Studebaker & Brackett PC

(57) ABSTRACT

Cushioning supports a bottom corner section of an article being packed. The corner section has a bottom face, a first side face, and a second side face. The cushioning includes a first cushioning member and a second cushioning member that are separable from each other. The first cushioning member includes a bottom section that faces the bottom face of the corner section of the packed article and a first side section that faces the first side face of the corner section of the packed article. The second cushioning member includes a second side section that faces the second side face of the corner section of the packed article.

4 Claims, 9 Drawing Sheets

CUSHIONING, PACKING, AND PACKAGE

INCORPORATION BY REFERENCE

The present application claims priority under 35 U.S.C. § 119 to Japanese Patent Application No. 2016-113430, filed on Jun. 7, 2016. The contents of this application are incorporated herein by reference in their entirety.

BACKGROUND

The present disclosure relates to cushioning, packing, and a package.

In one example, cushioning is disposed at bottom corners of a packing case to support an article that is packed in the packing case. The packed article is for example a heavy article provided with a handle for facilitating carrying the article. The handle may be located at a bottom corner of the article.

SUMMARY

Cushioning according to a first aspect of the present disclosure supports a bottom corner section of an article being packed. The cushioning includes a first cushioning member and a second cushioning member that are separable from each other. The corner section has a bottom face, a first side face, and a second side face. The first cushioning member includes a bottom section that faces the bottom face of the corner section of the packed article and a first side section that faces the first side face of the corner section of the packed article. The second cushioning member includes a second side section that faces the second side face of the corner section of the packed article.

Packing according to a second aspect of the present disclosure includes the cushioning according to the first aspect and a flat plate-shaped member. The cushioning according to the first aspect is placed on the flat plate-shaped member. According to the second aspect, the first cushioning member further includes a cut-out section, and the second cushioning member further includes a protrusion section. The protrusion section fits in the cut-out section. The cut-out section lies in a specific direction. The protrusion section protrudes in the specific direction. The first side section is plate-shaped. The specific direction is a direction intersecting with a principal plane of the first side section. The flat plate-shaped member includes a first restriction section configured to restrict movement of the first cushioning member and a second restriction section pivotable about a pivotal axis, between a first position and a second position. The second restriction section in the first position is flush with an upper surface of the flat plate-shaped member. The second restriction section in the second position protrudes from the upper surface of the flat plate-shaped member and restricts movement of the second cushioning member in and opposite to the specific direction. The pivotal axis of the second restriction section extends in a direction intersecting with the specific direction.

A package according to a third aspect of the present disclosure includes the packing according to the second aspect, a tray, a cover, and the article. The packing is placed on the tray. The cover mates with the tray to cover the packing. The article includes a protrusion member. The protrusion member is located in the second side face of the corner section. The protrusion member is pivotable between a retracted position and a protruding position. The protrusion member in the retracted position is contained within the article. The protrusion member in the protruding position protrudes from the second side face of the corner section.

DETAILED DESCRIPTION

Figure 1:
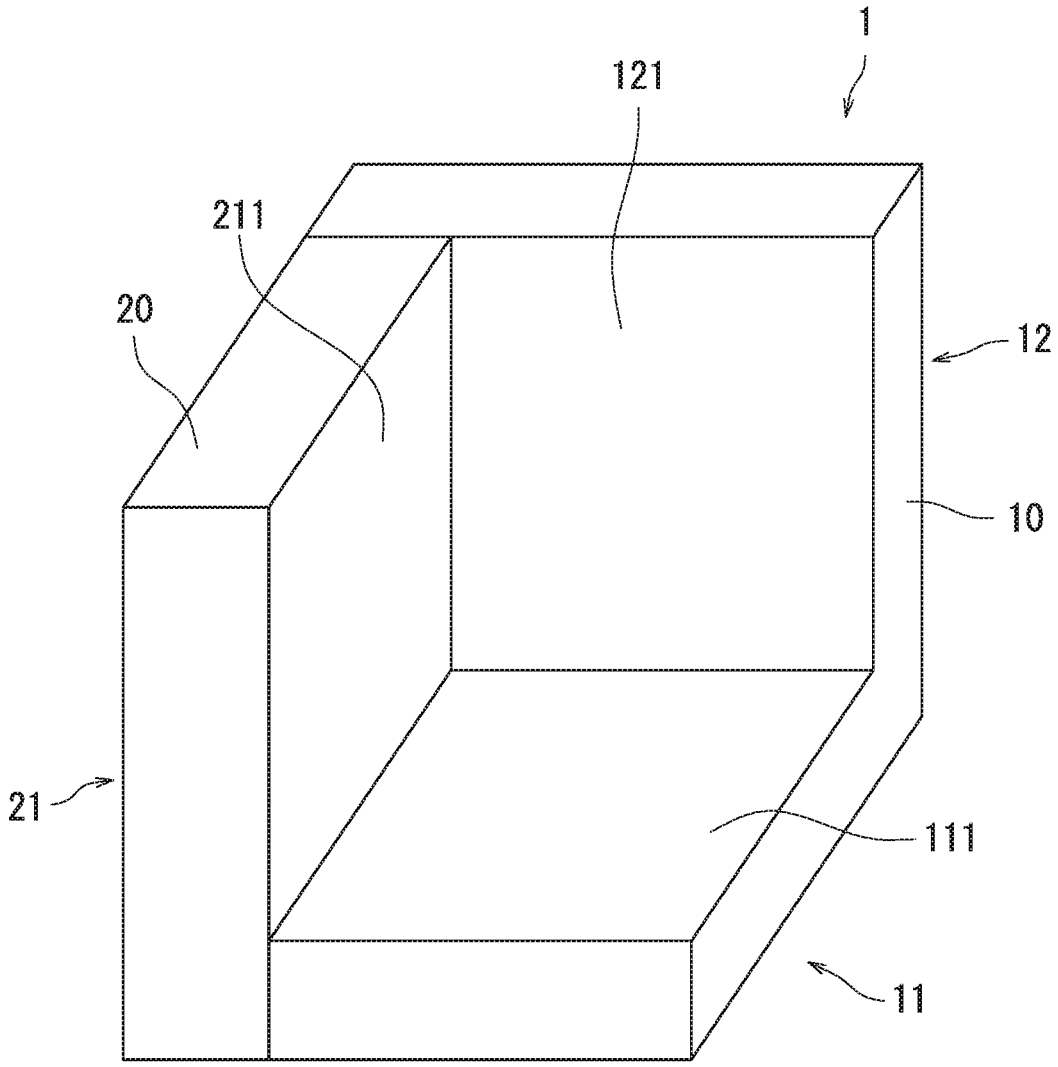
FIG. 1 is a diagram illustrating cushioning according to a first embodiment of the present disclosure.

The following describes embodiments of the present disclosure with reference to FIGS. 1 to 9. Elements that are the same or equivalent are indicated by the same reference signs in the drawings, and description thereof is not repeated.

First Embodiment

Figure 2:
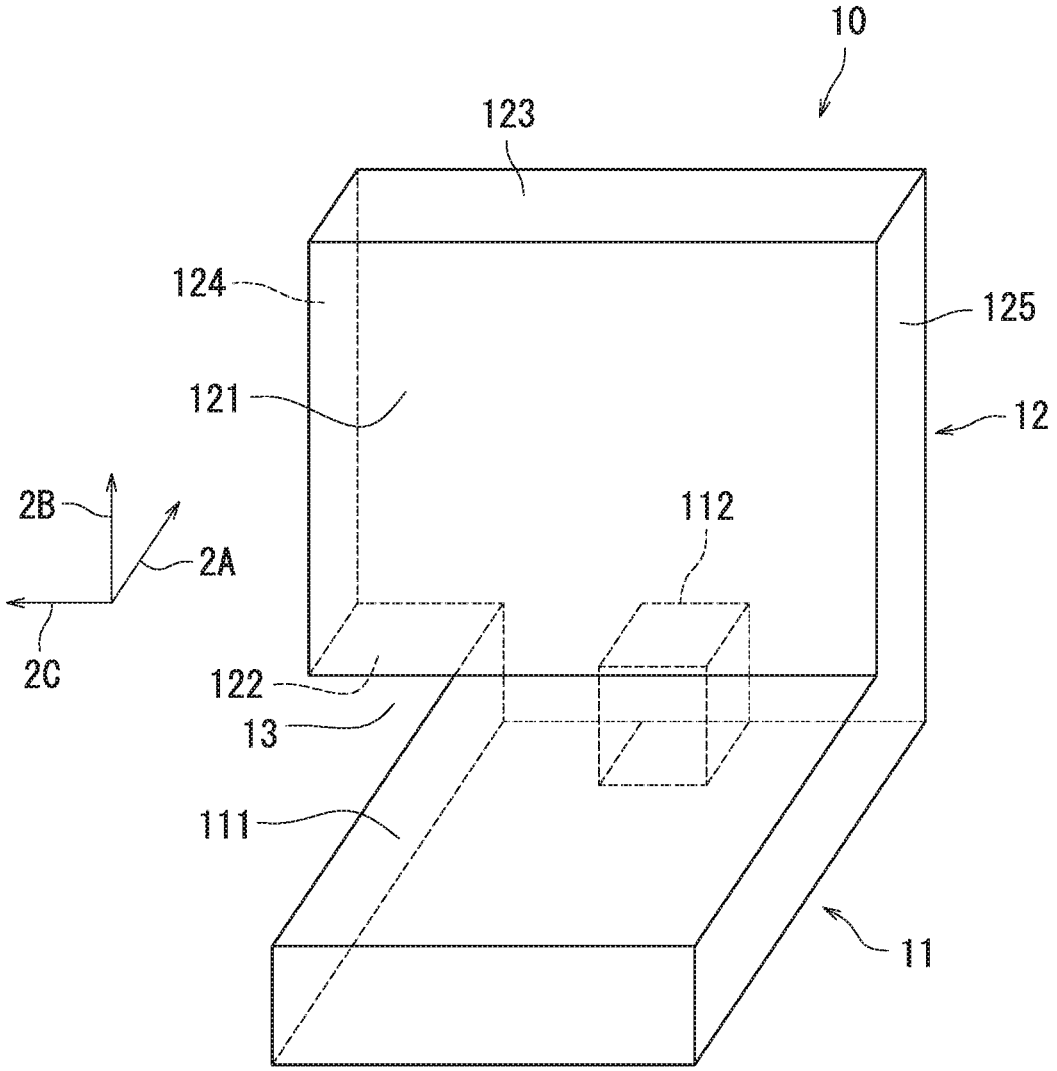
FIG. 2 is a diagram illustrating a first cushioning member illustrated in FIG. 1.
Figure 3:
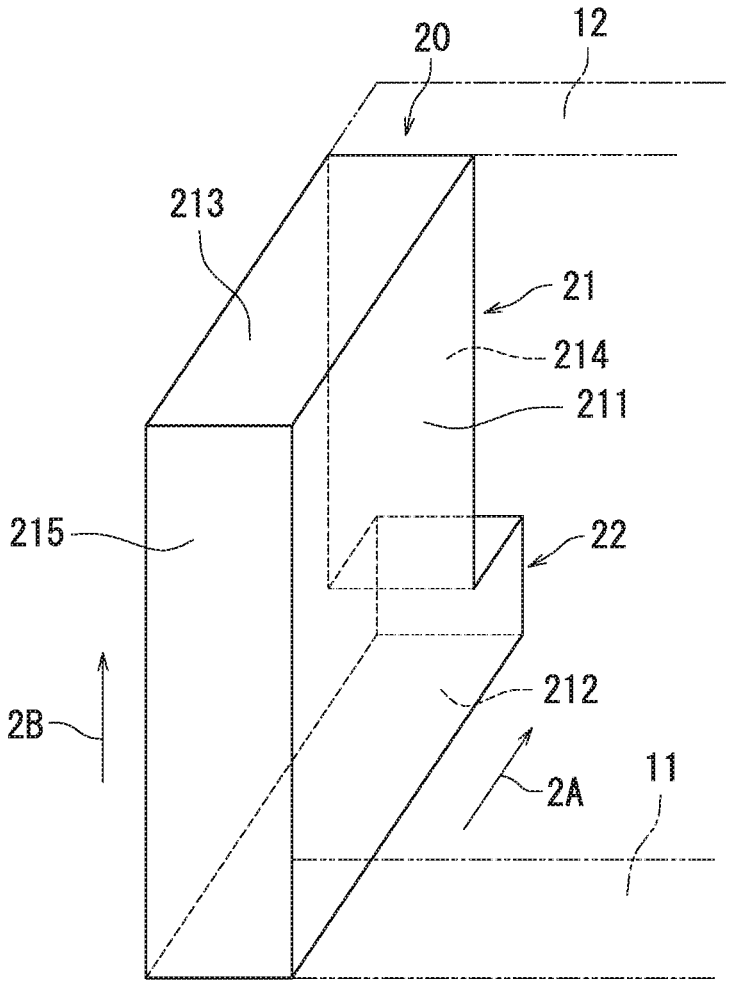
FIG. 3 is a diagram illustrating a second cushioning member illustrated in FIG. 1.

The following describes a first embodiment of the present disclosure with reference to FIGS. 1 to 3. FIG. 1 is cushioning 1 according to the first embodiment of the present disclosure.

The cushioning 1 is to support a bottom corner section of an article being packed. As illustrated in FIG. 1, the cushioning 1 includes a first cushioning member 10 and a second cushioning member 20 that are separable from each other. The corner section of the article has a bottom face, a first side face, and a second side face. The cushioning 1 is disposed at each of four bottom corners of a packing case in which the article is packed.

FIG. 2 illustrates the first cushioning member 10. As illustrated in FIG. 2, the first cushioning member 10 includes a bottom section 11, a first side section 12, and a cut-out section 13. The bottom section 11 is a substantially rectangular plate member and faces the bottom face of the corner section of the packed article. The bottom section 11 has an upper surface 111. The upper surface 111 of the bottom section 11 faces the bottom face of the corner section of the packed article while the cushioning 1 is supporting the packed article.

The first side section 12 is a substantially rectangular plate member and faces the first side face of the corner section of the packed article. The first side section 12 has a first vertical surface 121 perpendicular to the upper surface 111. The first vertical surface 121 of the first side section 12 faces the first side face of the corner section of the packed article while the cushioning 1 is supporting the packed article.

The cut-out section 13 lies in a direction (specific direction) intersecting with the first vertical surface 121. For example, the cut-out section 13 is formed in the first cushioning member 10 along a direction 2A perpendicular to the first vertical surface 121. The first side section 12 has end surfaces (an end surface 122 and an end surface 123) at opposite ends thereof in terms of a direction perpendicular to the upper surface 111 (a direction parallel to a direction 2B illustrated in FIG. 2). The cut-out section 13 is also along the end surface 122, which is adjacent to the bottom section 11. The first side section 12 further has end surfaces (an end surface 124 and an end surface 125) at opposite ends thereof in terms of a direction parallel to both the upper surface 111 and the first vertical surface 121 (a direction parallel to a direction 2C illustrated in FIG. 2). The cut-out section 13 is also along a plane including the end surface 124.

FIG. 3 illustrates a second cushioning member 20. As illustrated in FIG. 3, the second cushioning member 20 includes a second side section 21 and a protrusion section 22. The second side section 21 is a substantially rectangular plate member and faces the second side face of the corner section of the packed article. The second side section 21 has a second vertical surface 211. The second vertical surface 211 of the second side section 21 faces the second side face of the corner section of the packed article while the cushioning 1 is supporting the packed article. Furthermore, the second vertical surface 211 is perpendicular to the upper surface 111 and the first vertical surface 121 while the cushioning 1 is supporting the packed article.

The protrusion section 22 protrudes in the specific direction. The protrusion section 22 fits in the cut-out section 13. The protrusion section 22 of the second cushioning member 20 for example protrudes in the direction 2A. The second side section 21 has end surfaces (an end surface 212 and an end surface 213) at opposite ends thereof in terms of the direction parallel to the direction 2B. The protrusion section 22 is on a plane including the end surface 212, which is adjacent to the bottom section 11. The second side section 21 further has end surfaces (an end surface 214 and an end surface 215) at opposite ends thereof in terms of a direction parallel to the direction 2A. The protrusion section 22 is on the end surface 214, which is adjacent to the first side section 12.

As described above with reference to FIGS. 1 to 3, the cushioning 1 according to the present embodiment includes the first cushioning member 10 and the second cushioning member 20 that are separable from each other. In the first cushioning member 10, the bottom section 11 faces the bottom face of the corner section of the packed article, and the first side section 12 faces the first side face of the corner section of the packed article. In the second cushioning member 20, the second side section 21 faces the second side face of the corner section of the packed article. According to this configuration, the article can be placed in the packing case with only the first cushioning member 10, among the first cushioning member 10 and the second cushioning member 20, set in the packing case. The second cushioning member 20 can be set in the packing case after the article is packed in the packing case.

Accordingly, even if the article that is packed in the packing case has a handle at the second side face of the bottom corner section, for example, interference of a hand holding the handle with the cushioning 1 can be prevented. As a result, the article is readily packed in the packing case.

As described above with reference to FIGS. 1 to 3, the first cushioning member 10 according to the present embodiment includes the cut-out section 13, the second cushioning member 20 includes the protrusion section 22, and the protrusion section 22 fits in the cut-out section 13. Accordingly, the first cushioning member 10 and the second cushioning member 20 can be readily assembled into the cushioning 1.

Furthermore, as described above with reference to FIGS. 1 to 3, the cut-out section 13 according to the present embodiment lies in the specific direction, and the protrusion section 22 protrudes in the specific direction. The specific direction refers to a direction intersecting with a principal plane of the first side section 12. Accordingly, the first cushioning member 10 and the second cushioning member 20 can be assembled into the cushioning 1 by setting in the second cushioning member 20 in the specific direction. Thus, the first cushioning member 10 and the second cushioning member 20 are readily assembled into the cushioning 1 by placing only the first cushioning member 10, among the first cushioning member 10 and the second cushioning member 20, in the packing case, and thereafter placing the second cushioning member 20 in the packing case.

Second Embodiment

Figure 4:
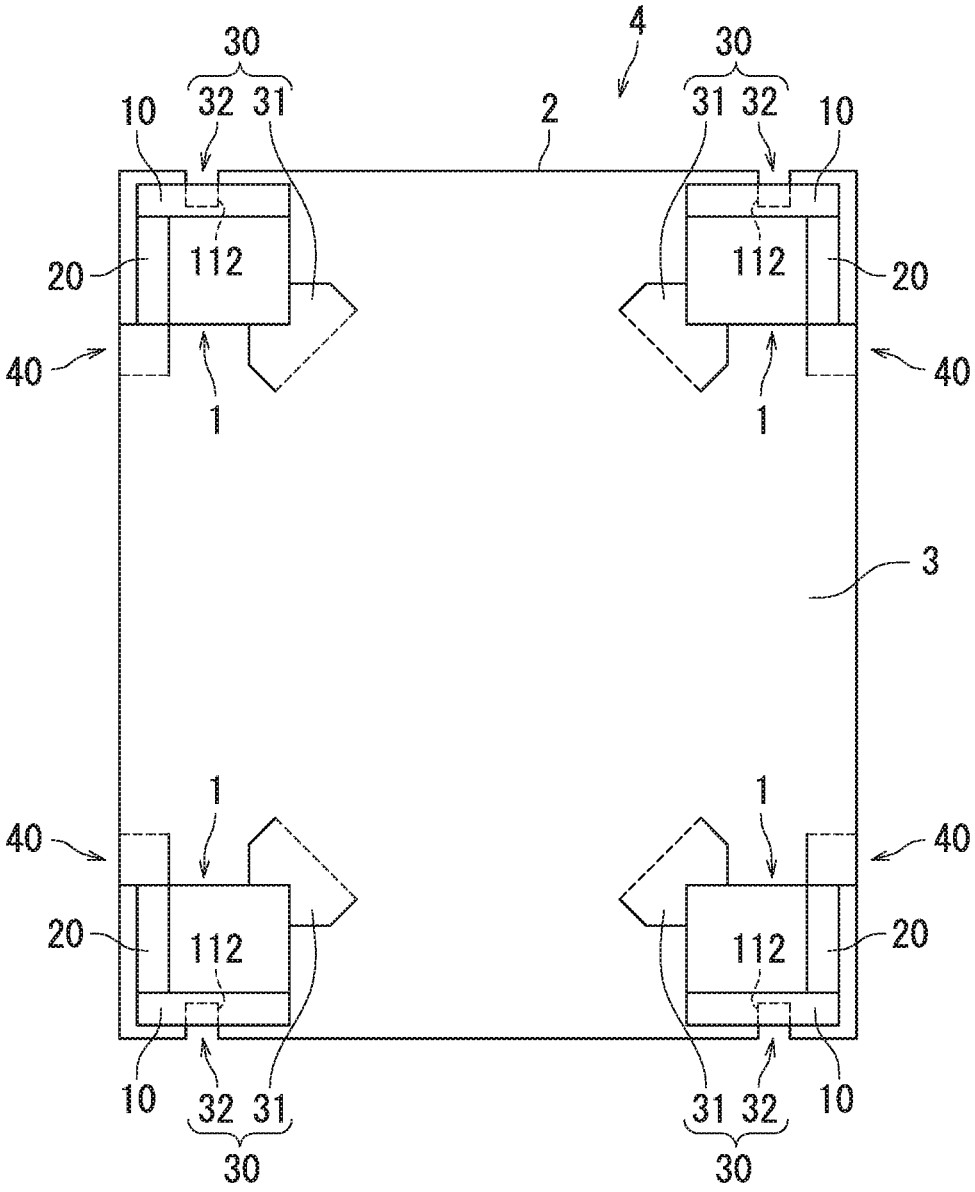
FIG. 4 is a diagram illustrating packing according to a second embodiment of the present disclosure.

The following describes a second embodiment of the present disclosure with reference to FIGS. 4 to 7. FIG. 4 illustrates packing 4 according to the second embodiment of the present disclosure.

As illustrated in FIG. 4, the packing 4 includes a plurality of pieces of the cushioning 1 (four pieces of the cushioning 1 in the present embodiment) and a flat plate-shaped member 2 on which the plurality of pieces of the cushioning 1 are placed. The flat plate-shaped member 2 has a substantially rectangular shape, and the respective pieces of the cushioning 1 are placed at positions of four corners on an upper surface 3 of the flat plate-shaped member 2.

The flat plate-shaped member 2 includes first restriction sections 30 and second restriction sections 40. The first restriction sections 30 restrict movement of the respective first cushioning members 10. The second restriction sections 40 restrict movement of the respective second cushioning members 20.

Figure 5:
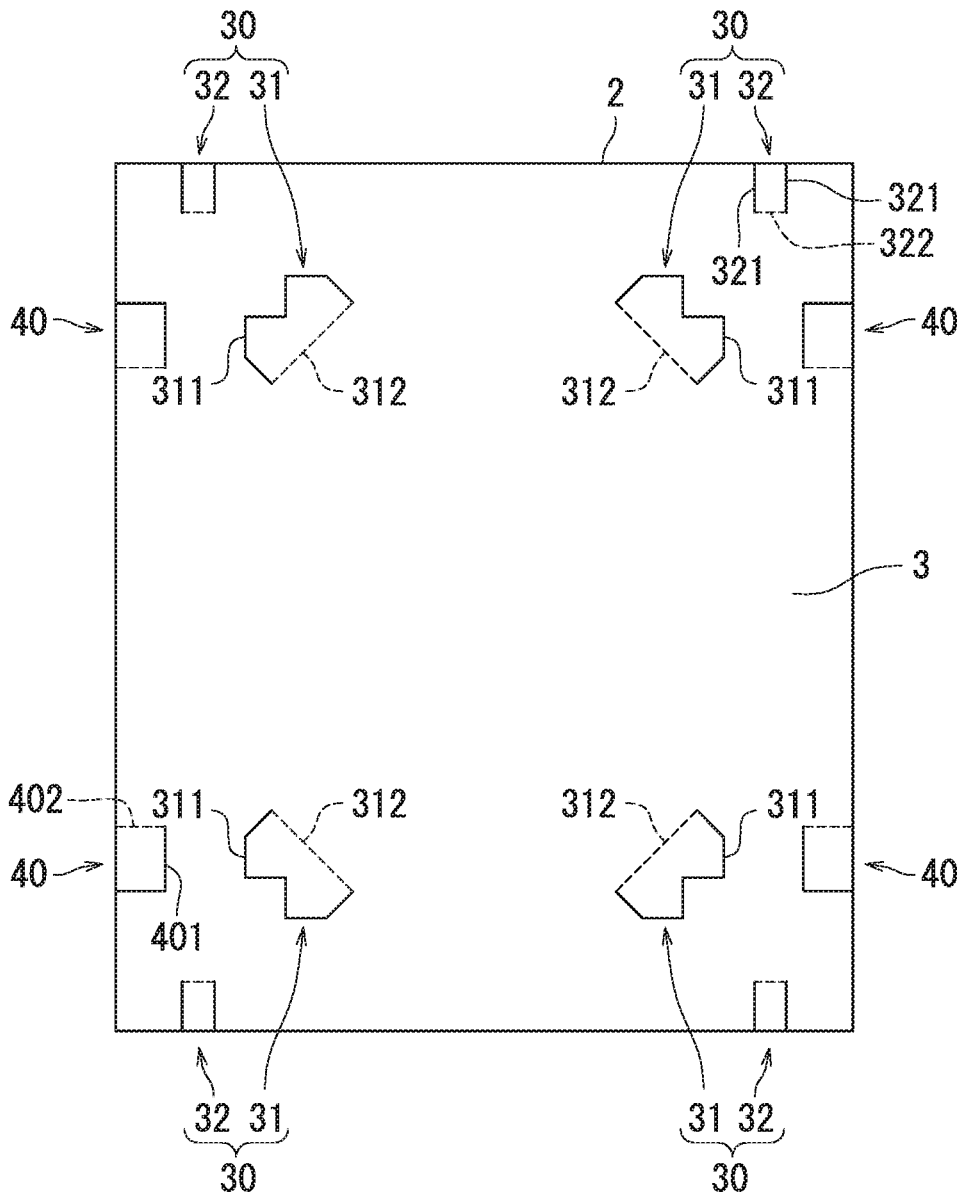
FIG. 5 is a diagram illustrating a flat plate-shaped member illustrated in FIG. 4.

FIG. 5 illustrates the flat plate-shaped member 2. As illustrated in FIG. 5, each of the first restriction sections 30 includes a first raised part 31 and a second raised part 32 (raised part). The first raised part 31 is formed by cutting a portion of the flat plate-shaped member 2 along a substantially chevron-shaped cut line 311 and upwardly folding the cut portion. The first raised part 31 is pivotable about a fold 312. The second raised part 32 is formed by cutting a portion of the flat plate-shaped member 2 along two parallel cut lines 321 and upwardly folding the cut portion. The second raised part 32 is pivotable about a fold 322.

The second restriction section 40 is formed by cutting a portion of the flat plate-shaped member 2 along a bending cut line 401, which bends at a right angle, and upwardly folding the cut portion. The second restriction section 40 is pivotable about a fold 402.

Figure 6:
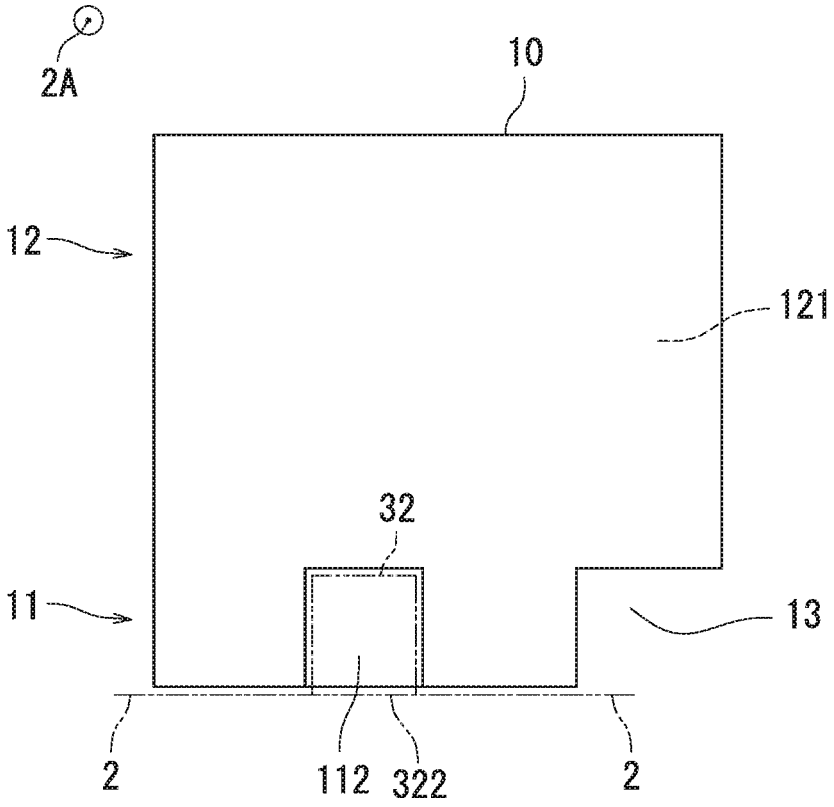
FIG. 6 is a diagram illustrating the first cushioning member illustrated in FIG. 1.

FIG. 6 is a diagram illustrating the first cushioning member 10 as viewed against the direction 2A from an opposite side of the first cushioning member 10 to the first vertical surface 121. As illustrated in FIG. 6, the first cushioning member 10 has a recess 112 in the bottom section 11. That is, the bottom section 11 of the first cushioning member 10 has the recess 112. The second raised part 32 fits in the recess 112. As a result of the second raised part 32 fitting in the recess 112, movement of the second cushioning member 20 in directions perpendicular to the direction 2A is restricted.

Figure 7:
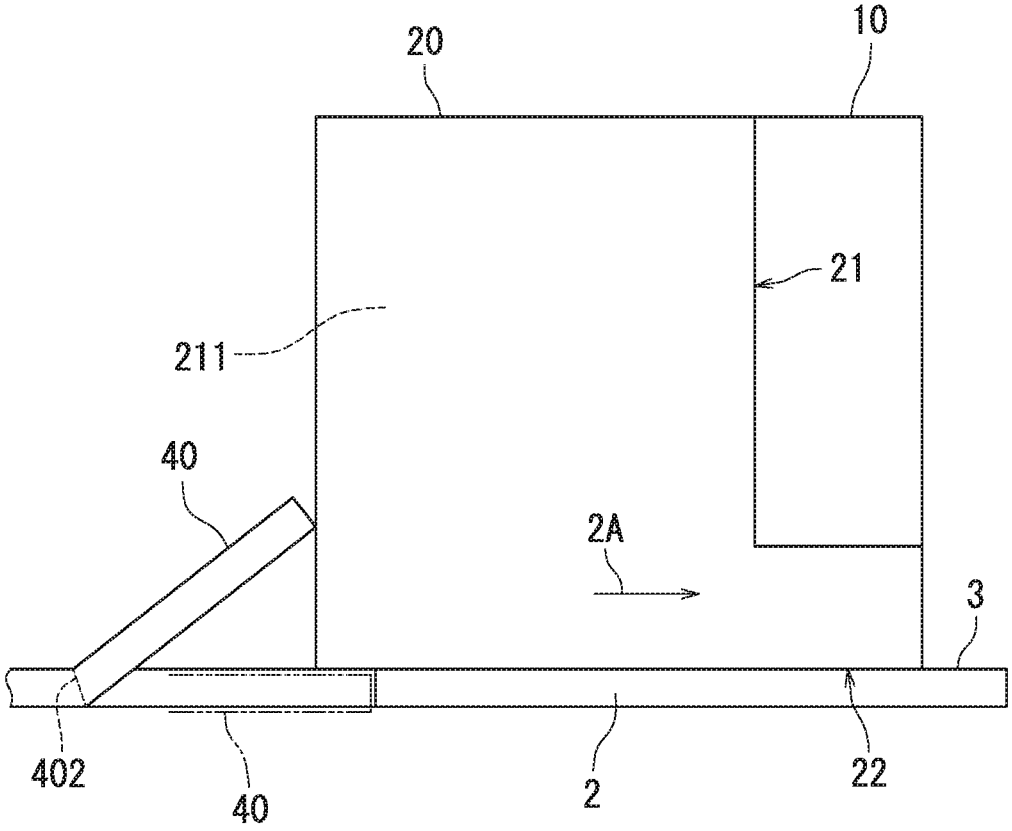
FIG. 7 is a diagram illustrating the second restriction section illustrated in FIG. 4.

FIG. 7 illustrates the second restriction section 40. The second restriction section 40 is pivotable about the fold 402, between a first position, which is represented by a dashed and double dotted line in FIG. 7, and a second position, which is represented by a solid line in FIG. 7. The second restriction section 40 in the first position is flush with the upper surface 3 of the flat plate-shaped member 2. The second restriction section 40 in the second position protrudes from the upper surface 3 of the flat plate-shaped member 2 and restricts movement of the second cushioning member 20 in and opposite to the direction 2A. The fold 402 serving as a pivotal axis of the second restriction section 40 is elongated in a direction intersecting with the direction 2A. For example, the fold 402 is elongated in the direction perpendicular to the direction 2A.

As described above with reference to FIGS. 4 to 7, the pivotal axis of the second restriction section 40 according to the present embodiment is elongated in a direction intersecting with the direction 2A. The cushioning 1 according to the present embodiment can therefore easily restrict movement of the second cushioning member 20 in and opposite to the specific direction.

More specifically, the second cushioning member 20 is for example placed on the bottom of the packing case after an article is packed in the packing case. Once the article is packed in the packing case, only small space is left for an action to restrict movement of the second cushioning member 20 using the second restriction section 40. An action like the action to cause the second raised part 32 to fit in the recess 112 is difficult to perform in small space. However, the pivotal axis of the second restriction section 40 according to the present embodiment is elongated in the direction perpendicular to the specific direction. Accordingly, movement of the second cushioning member 20 in the specific direction can be restricted only by pivoting the second restriction section 40 such that a distal end of the second restriction section 40 in the second position abuts the second cushioning member 20. Thus, movement of the second cushioning member 20 in and opposite to the specific direction can be easily restricted.

Third Embodiment

Figure 8:
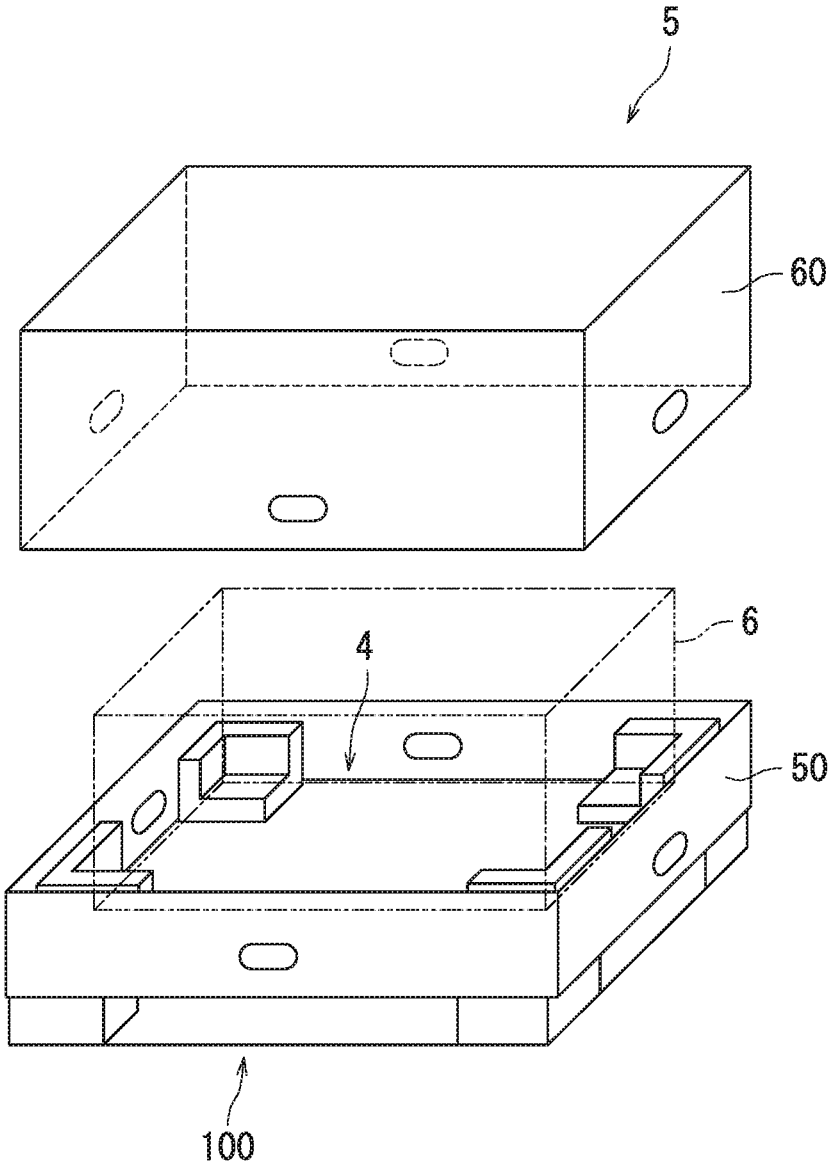
FIG. 8 is a diagram illustrating a package according to a third embodiment of the present disclosure.
Figure 9:
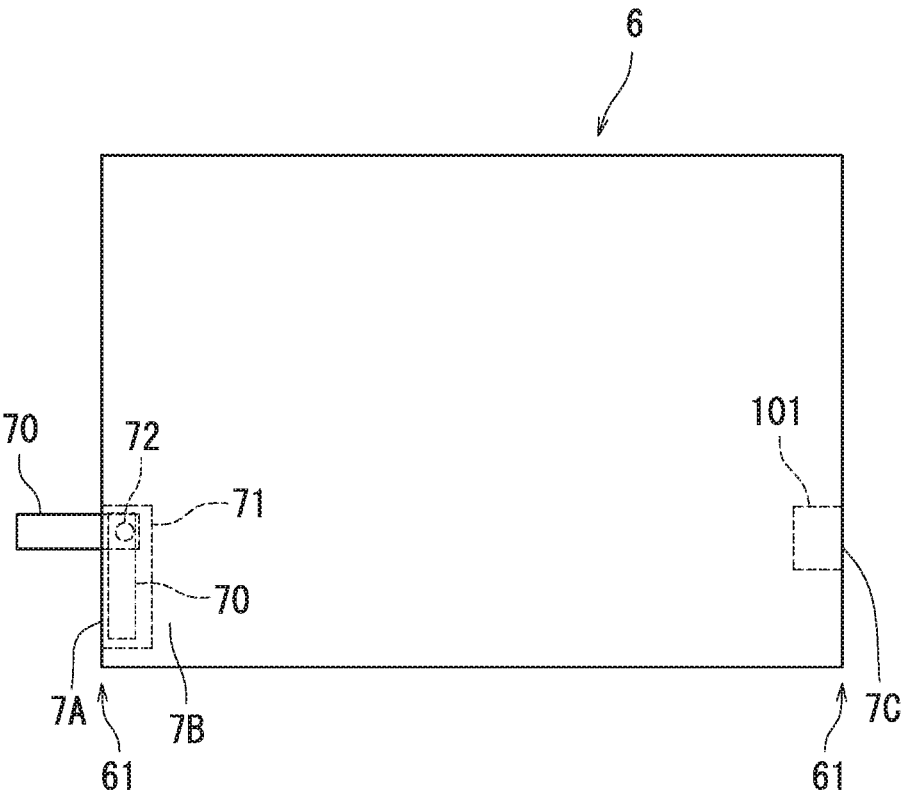
FIG. 9 is a diagram illustrating an article illustrated in FIG. 8.

The following describes a third embodiment of the present disclosure with reference to FIGS. 8 and 9. FIG. 8 illustrates a package 5 according to the third embodiment of the present disclosure.

As illustrated in FIG. 8, the package 5 includes the packing 4, a tray 50, a cover 60, and an article 6. The packing 4 is placed on the tray 50. The cover 60 mates with the tray 50 to cover the packing 4. The tray 50 is placed on a pallet 100. The tray 50 and the cover 60 forms a packing case in which the article is packed.

FIG. 9 illustrates the article 6. As illustrated in FIG. 9, the article 6 has a substantially rectangular parallelepiped shape, and includes a protrusion member 70 and a recess 71. The protrusion member 70 and the recess 71 are located in a second side face 7A of a bottom corner section 61 of the article 6. The second side face 7A is adjacent to a first side face 7B of the corner section 61. The protrusion member 70 is shiftable between a retracted position and a protruding position. More specifically, the protrusion member 70 is disposed in the article 6 so as to be pivotable about a shaft 72, between the retracted position and the protruding position. The shaft 72 is disposed in the article 6 perpendicularly to the first side face 7B.

The protrusion member 70 in the retracted position is contained within the article 6. More specifically, the protrusion member 70 is contained within the recess 71. The protrusion member 70 in the retracted position is represented by a dashed line.

The protrusion member 70 in the protruding position protrudes from the second side face 7A and functions as a handle. The protrusion member 70 in the protruding position is represented by a solid line. The article 6 further has a recess 101 in a third side face 7C, which is a face opposite to the second side face 7A. The recess 101 also functions as a handle.

According to the present embodiment, as described above with reference to FIGS. 8 and 9, the protrusion member 70 that is pivotable between the retracted position and the protruding position is provided in the second side face 7A of the corner section 61. Accordingly, after only the first cushioning member 10, among the first cushioning member 10 and the second cushioning member 20, is placed on the flat plate-shaped member 2, the protrusion member 70 in the protruding position is gripped to place the article 6 on the tray 50. After the article 6 is placed on the tray 50, the protrusion member 70 can be pivoted into the retracted position. Such a configuration prevents the protrusion member 70 from interfering with the cushioning 1 due to being in the protruding position, while facilitating placement of the article 6 on the tray 50.

Through the above, embodiments of the present disclosure have been described with reference to the drawings (FIGS. 1 to 9). According to the above-described embodiments of the present disclosure, the cushioning 1 includes the first cushioning member 10 and the second cushioning member 20 that are separable from each other. Accordingly, the article 6 can be packed in the packing case with only the first cushioning member 10, among the first cushioning member 10 and the second cushioning member 20, set in the packing case. Such a configuration prevents a hand holding the handle from interfering with the cushioning 1 when the article 6 is packed in the packing case, facilitating packing of the article 6 in the packing case.

However, the present disclosure is not limited to the above embodiments and may be implemented in various different forms that do not deviate from the essence of the present disclosure (for example, as described below in section (1)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as shapes and dimensions, are merely examples and are not intended as specific limitations. Various alterations may be made so long as there is no substantial deviation from the effects of the present disclosure.

(1) According to the above-described embodiments of the present disclosure, the cut-out section 13 is along the end surface 122 as illustrated in FIG. 2. However, the present disclosure is not limited to such embodiments. For example, the cut-out section 13 may be along the end surface 123 or may be provided between the end surface 122 and the end surface 123 so long as the cut-out section 13 is on the plane including the end surface 124. Furthermore, according to the above-described embodiments of the present disclosure, the protrusion section 22 is on the plane including the end surface 212 as illustrated in FIG. 3. However, the present disclosure is not limited to such embodiments. For example, the protrusion section 22 may be on a plane including the end surface 213 or may be provided between the plane including the end surface 213 and the plane including the end surface 212 so long as the protrusion section 22 is on the end surface 214.

What is claimed is:

1. A package comprising:

an article to be packed and including a bottom corner section;

a packing;

a tray on which the packing is placed; and a cover configured to mate with the tray to cover the packing, wherein the packing includes:

a cushioning configured to support the bottom corner section of the article; and a flat plate-shaped member on which the cushioning is placed, the cushioning includes a first cushioning member and a second cushioning member that are separable from each other, the bottom corner section has a bottom face, a first side face, and a second side face, the first cushioning member includes:

a bottom section that faces the bottom face of the bottom corner section;

a first side section that faces the first side face of the bottom corner section; and a cut-out section, the second cushioning member includes:

a second side section that faces the second side face of the bottom corner section; and a protrusion section that fits in the cut-out section, the cut-out section lies in a specific direction, the protrusion section protrudes in the specific direction, the first side section is plate-shaped, the specific direction is a direction intersecting with a principal plane of the first side section, the flat plate-shaped member includes:

a first restriction section configured to restrict movement of the first cushioning member; and a second restriction section pivotable about a pivotal axis between a first position and a second position, the second restriction section in the first position is flush with an upper surface of the flat plate-shaped member, the second restriction section in the second position protrudes from the upper surface of the flat plate-shaped member and restricts movement of the second cushioning member in and opposite to the specific direction, the pivotal axis of the second restriction section extends in a direction intersecting with the specific direction, the article includes a protrusion member, the protrusion member is located in the second side face of the bottom corner section, the protrusion member being pivotable between a retracted position and a protruding position, the protrusion member in the retracted position is contained within the article, and the protrusion member in the protruding position protrudes from the second side face of the bottom corner section.

2. The package according to claim 1, wherein the bottom section has an upper surface that faces the bottom face of the bottom corner section of the packed article, the first side section has a first vertical surface perpendicular to the upper surface, the cut-out section lies in the specific direction, the specific direction is the direction intersecting with the principal plane of the first side section, and the specific direction is a direction perpendicular to the first vertical surface.

3. The package according to claim 1, wherein the first restriction section includes a raised part, the raised part being a portion of the flat plate-shaped member that is cut along two parallel cut lines and folded upwardly, the bottom section of the first cushioning member has a recess, the raised part is pivotable about a fold, and the raised part fits in the recess of the bottom section.

4. The package according to claim 1, wherein the article has a recess in the second side face of the bottom corner section, and the protrusion member in the retracted position is contained within the recess of the article.

* * * * *